United States Patent [19]

Marchetti

[11] Patent Number: 4,545,176

[45] Date of Patent: Oct. 8, 1985

[54] CARTON SEALING MACHINE WITH POSSIBILITY OF IMMEDIATE OPENING OF THE SEALING AREA DURING WORKING

[75] Inventor: Augusto Marchetti, Milan, Italy

[73] Assignee: Comarme, S.p.A., Milan, Italy

[21] Appl. No.: 449,469

[22] Filed: Dec. 8, 1982

[30] Foreign Application Priority Data

Feb. 17, 1982 [IT] Italy ..... 19692 A/82

[51] Int. Cl.[4] ..... B65B 57/00

[52] U.S. Cl. ..... 53/76; 53/374

[58] Field of Search ..... 53/75, 76, 77, 374; 156/358, 360, 468; 100/8

[56] References Cited

U.S. PATENT DOCUMENTS 3,502,256 3/1970 Boulay et al. ..... 53/75

4,028,865 6/1977 Loveland et al. ..... 53/76

4,044,527 8/1977 Ulrich et al. ..... 53/76

4,262,469 4/1981 Ooms et al. ..... 53/76

4,317,319 3/1982 Price ..... 53/76

FOREIGN PATENT DOCUMENTS 1482734 8/1977 United Kingdom .

*Primary Examiner*—W. D. Bray

*Attorney, Agent, or Firm*—McAulay, Fields, Fisher, Goldstein & Nissen

[57] ABSTRACT

A carton sealing machine provided with a pushbutton control situated on the upper sealing head for controlling the separation of conveying belts and lifting of an upper sealing head to allow the easy, efficient and sure intervention of the operator in case of jamming of a carton, and the control can also be used to stop the rotational movement of the belts.

10 Claims, 3 Drawing Figures

CARTON SEALING MACHINE WITH POSSIBILITY OF IMMEDIATE OPENING OF THE SEALING AREA DURING WORKING

BACKGROUND OF THE INVENTION

The present invention relates to a carton sealing machine, which provides the possibility of controlling the immediate opening of the sealing area during working.

There are known those carton sealing machines which on a support base provide a pair of conveying belts able to enage the carton sides in order to control the advancement of the cartons along said base and through a conveniently equipped sealing area. This latter comprises more precisely an upper sealing head able to engage the carton top to apply a strip of adhesive sealing tape, as well as a lower sealing unit able to engage the carton bottom.

Particularly there are known those sealing machines, that, in order to operate on cartons of any width and height, provision is made at the commencement of the work for the conveying belts and the upper sealing head to be displaced from respective rest positions in which the belts are separated from each other and the upper sealing head is in its furn very close to the carton support base.

In the machines of this kind the operative cycle substantially provides that the introduction of a carton on the above mentioned support base causes, by means of suitable sensors, firstly the raising of the upper sealing head to a height corresponding to that of the carton and then the mutual approaching of the conveying belts towards each other up to the conveying engagement of the conveyor belts with the carton sides. The carton can thus advance through the sealing area, while receiving the sealing adhesive tapes, and then to leave the machine sealed. At that time, always by means of suitable sensors, the machine controls the return of the conveyor belts and the upper sealing head to its rest position and the stopping as well of the rotational movement of the belts.

Even if the working of such machines is usually perfect, it can however happen that a possibly deformed or badly disposed carton becomes locked or jammed inside the sealing area, for example by entangling with its upper flap among the various members of the sealing head. In such case there occurs a machine jamming, which requires the operator intervention.

This latter presents however many difficulties, as the conveying belts and the upper sealing head are substantially "closed" around the cartons, thereby making it complicated for someone and perhaps also dangerous (because of the movement of the belts) to execute manual interventions to set the locked carton properly or to extract it.

The object of the present invention is therefore to provide a carton sealing machine which has suitable control means to permit the immediate opening of the sealing area in case of carton jamming or other similar difficulty.

According to the invention such an object is reached by means of a machine provided with a control member for causing the immediate displacement of the conveying belts into a position position of maximum mutual removal and of the upper sealing head into a position of maximum raising with respect to the carton support base.

By operating said control member it is thus possible to cause the immediate "opening" of the sealing area, with consequent possibility of easy, efficient and sure manual intervention with respect to the jammed carton for the extraction thereof.

If desired, it is also possible to have the same control member also to stop the rotational movement of the belts, in order to improve the safety conditions of the machine.

An embodiment of the present invention is illustrated for better clarity in the enclosed drawings, in which:

DETAILED DESCRIPTION OF THE DRAWINGS

Figure 1:
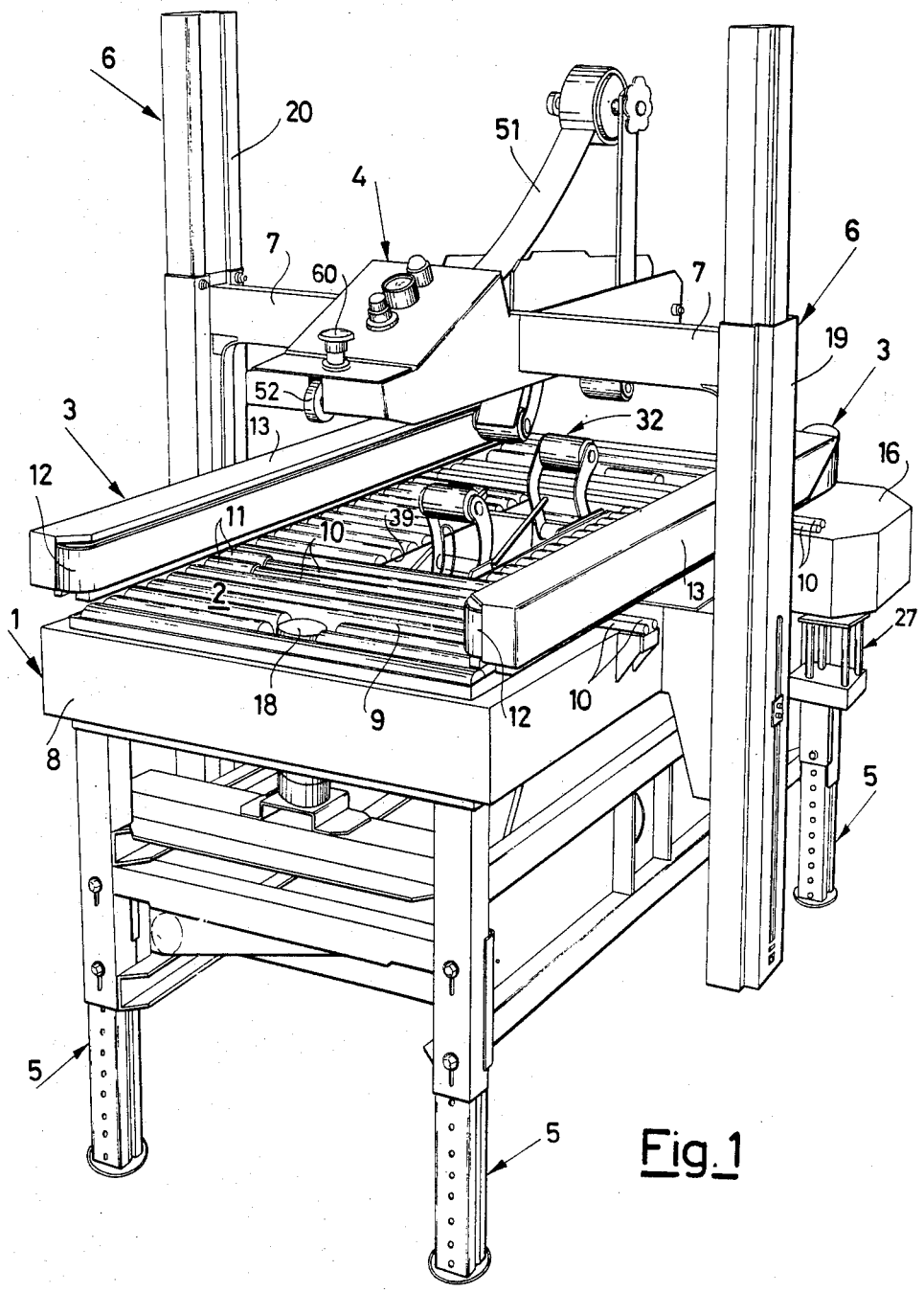
FIG. 1 shows a sealing machine according to the invention in general perspective views.

With reference to FIG. 1, there is illustrated a sealing machine for variable width and height cartons, which comprises, in general, a roller base 1 defining a support plane or base 2 for the cartons to be sealed, two belt conveying units 3 extending in a direction along the direction of movement of the cartons and disposed at the two sides of the support base and movable towards and away from each other in a direction transverse to the direction of carton movement when the belts are moved towards each other to be engaged with the sides of the cartons for the rectilinear advancement of the cartons from one end to the other of the support base (from left to right, looking at FIG. 1). A lower sealing unit 32 is housed in a space 39 of the base 1, and an upper sealing head or unit 4 superimposed above the support plane 2 at a height which is variable. More precisely, the sealing head 4 is normally in a rest position very near the support plane 2 and is temporarily liftable from the rest position at the commencement of the operation for each carton to be sealed.

Besides, there is provided a support frame, which includes four legs 5 provided for the support of the base 1 and a pair of columns 6 extending upwards from the base 1 for the support and the guide by means of arms 7 connected thereto, of the sealing head 4.

Going now into greater details, the base 1 is really constituted by a rectangular frame 8 and by a succession of a plurality of parallel transverse rollers 9 arranged in a direction transverse to the direction of carton movement through the sealing area and supported in a freely rotating way by the frame 8. Among the various rollers 9 there are also interposed two pairs of cylindrical rods 10, on everyone of which there is slidingly mounted sleeves 11 intended for the support of the conveying units 3.

These conveying units 3 are of the kind, known per se, constituted by closed-loop conveying belts 12 disposed around respective successions of drive and guide pulleys not shown in the drawings. The above mentioned pulleys and the relative belts 12 are all housed inside respective carters 13 supported by the sliding sleeves 11. By controlling the sliding of these latter along the rods 10 by means of a suitable and known per se device connected to a pneumatic cylinder 18 (FIG. 1), the two conveying units 3 are therefore movable towards and away from each other between the removed rest position as shown in FIG. 1 and a variably approached position in which the conveying belts 12 can be engaged, in a known way too, with the carton sides to cause the advancement thereof through the sealing area defined by the upper sealing head 4 and by the lower sealing unit 32.

For the rotation of the drive pulleys of the conveying belts 12, on the other hand, there is provided an electric motor 16, which is connected to the same pulleys through a transmission system, known per se, comprising a releasable friction clutch 27. This latter is controlled by a pneumatic cylinder indicated with the reference number 41 in the pneumatic scheme of FIG. 3, with reference to which the mode of operation will be described.

As previously said, the sealing head 4 is supported and guided in its vertical movements by a pair of columns 6 supported by the base 1. More precisely, the sealing head 4 is connected by the arms 7 to respective slides slidingly housed inside respective box-like fixed parts 19 of the columns, above which adjustable projections 20 extend. Pneumatic cylinders 50 are housed inside the above mentioned fixed parts 19 for lifting of the head 4 when required. Said pneumatic cylinders are indicated with reference number 50 in the pneumatic scheme of FIG. 3.

Figure 2:
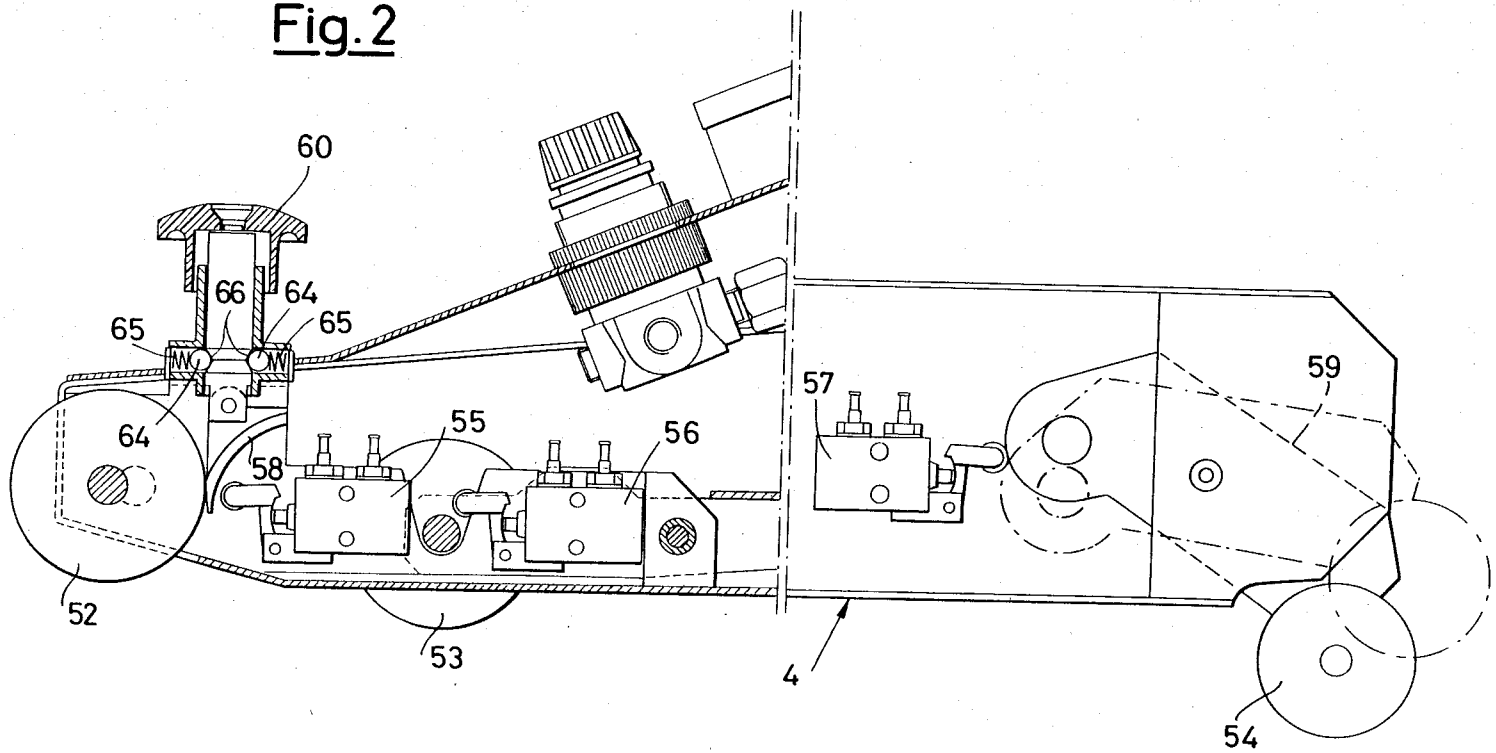
FIG. 2 shows an enlarged detail of the inlet and the outlet parts of an upper sealing head forming part of the machine of FIG. 1.
Figure 3:
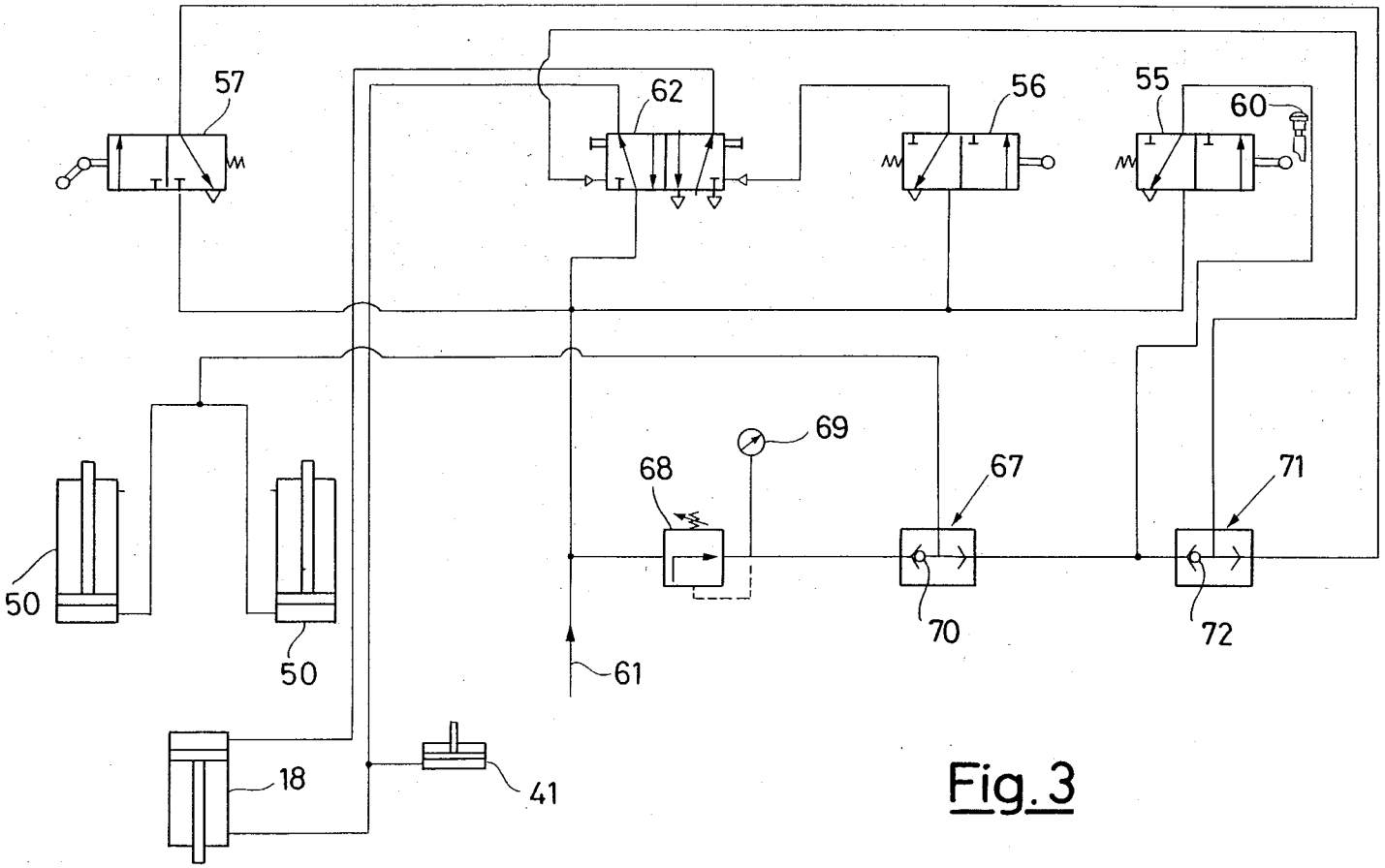
FIG. 3 shows a general scheme of the pneumatic control circuit for the machine of FIG. 1.

The sealing head 4 comprises in its turn, in addition to the usual members for the support and the application of a sealing tape 51 (FIG. 1), a series of sensors 52, 53 and 54 connected to respective pneumatic valves 55, 56 and 57 illustrated in FIG. 2 and then shown in the pneumatic control circuit again in the pneumatic scheme of FIG. 3. As one can see from FIG. 2, the sensor 52 is placed at the inlet of the sealing area to detect the arrival of a carton front and in such case to control the activation of the valve 55 through a flat spring 58, the sensor 53 is placed in a little more ahead in the path of carton movement to detect the presence of the top of the same carton under the sealing head and to control in such case the activation of the valve 56, and the sensor 54 is finally placed at the outlet of the sealing area to control through a lever 59 (stressed by its own weight in the position illustrated in solid line in FIG. 2) and an unidirectional-hinge arm the activation of the valve 57 during the passage of the carton top.

Besides the sealing head 4 has at its inlet end a pushbutton 60 has a stem which is normally kept in the raised position of FIG. 2 by a pair of balls 64 stressed by respective springs 65 in respective transversal notches 66 provided in the stem and are axially slidable in a seat 67 until pushbutton 60 takes and keeps a lowered position in which it engages flat spring 58, and through the flat spring 58, pushbutton 60 controls the activation of the valve 55.

The machine illustrated in the drawings finally comprises a pneumatic control circuit (FIG. 3), which uses a compressed air feed or line 61 and also includes a two-position distributing valve 62, the control of which is provided from time to time by the valves 56 and 57. According to the controlled position, the distributing valve 62 controls the operation in one way or another the two pneumatic cylinders 18 and 41, which respectively control the mutual movement of the conveying units 3 and, through the clutch or friction 27, the rotary movement of the conveying belts 12. On the position of the valve 55 there depends in its turn the feed of air to the cylinders 50 for their operation in the sense corresponding to the going up or raising of the sealing head 4 or (with valve 55 in the rest position of FIG. 3) the connection to discharge of the same cylinders 50 for their other operation under the pressure of the weight of the sealing head 4. A flow cut-off valve 67 is interposed between the cylinders 50 and the valve 55 in order to fix a minimum value to the air pressure of the discharge duct of the cylinders 50, and therefore to the pressure exerted by the weight of the sealing head 4 on the carton beneath the sealing head, when the same head, going down, meets with the carton top. Said cut-off valve is of the kind described in the U.S. Pat. No. 4,060,442, of which the same Applicant of the present application is owner, and substantially is based on the fact that a control member 70 thereof (represented as a ball in FIG. 3) is subjected through a pressure regulator 68 with gauge 69 to a predetermined pressure which allows it to lock the air outflow from the cylinders 50 and towards the discharge of the valve 55 (in the position of FIG. 3) when the pressure of the air thrown out from the above mentioned cylinder 50 falls below said predetermined pressure as a result of the resting of the sealing head 4 on the carton top. There is finally provided a three-way connection element 71, one way of which, connected to the cut-off valve 67 and to the valve 55, is provided with a check valve 72.

OPERATION

By the effect of the described structure, the sealing machine illustrated in the drawings operates as follows. At rest, the distributing valve 62 being in the position of FIG. 3, the compressed air coming from line 61 causes and moves the pistons of the cylinder 18 and 41 to keep, the first one, in a raised position such as to keep away the conveying units 3 from the sides of a carton and, the second one, also is kept in raised position such as to assure the release of the clutch 27 and therefore, with the motor 16 started too, the stopping of the rotational movement of the conveying belts 12. The rest position of the valve 55 on the other hand keeps the cylinders 50 in the lowered position to which corresponds the disposition of the sealing head 4 (stressed by its own weight) in the chosen lowered rest position.

During the introduction of a carton to be sealed (with upper and lower flaps already folded in closed position), the front wall of the carton is made lie against the inlet sensor 52, which causes the activation of the valve 55. Compressed air is consequently fed through the valve 55 and the cut-off valve 67 (with the control member 70 in the position of FIG. 3) to the cylinders 50, which cause the raising of the sealing head 4 up to the end of the engagement between the carton and the sensor 52. While the carton is still subjected to a brief manual advancement, the valve 55 then comes back in the rest position of FIG. 3, and is connected to discharge the cylinders 50 through the cut-off valve 67, whose control member 70, by moving from left to right with respect to FIG. 3, locks the outflow of the air from the cylinders 50 as soon as the pressure in the discharge duct goes below the predetermined value fixed by the regulator 68 as a consequence of the fact that the sealing head 4 is touching the top of the carton; the resting of the sealing head happens therefore at suitable predetermined pressure. The engagement of the sealing head 4 with the top of the carton also causes the operation of the sensor 53 and the consequent activation of the valve 56, which in its turn causes the activation of the distributing valve 62. Through this latter compressed air is then fed to the upper chamber of the cylinder 18, while the lower chambers of the cylinder 18 and 41 are connected to discharge. The cylinder 18 controls then the mutual approaching of the conveying units 3 up to the engagement of the conveying belts 12 with the carton sides, and at the same time the clutch 27 connects the motor 16 to the same conveying belts 12, which, by starting, cause the advancement of the carton through the sealing area to allow the upper sealing head 4 and the lower sealing unit 32 to apply strips of adhesive tape, respectively, on the top and on the bottom of the carton.

The carton then engages the outlet sensor 54, which, because of the articulated arm interposed between the lever 59 and the valve 57, has no effect on the valve 57, which therefore remains in the rest position illustrated in FIG. 3.

Nothing happens at the release of the sensor 53, which can precede or follow the engagement of the sensor 54, while on the contrary it is important following release of the outlet sensor 54. In fact this causes the brief activation of the valve 57 and consequently the generation of a contol pulse, whose result is to cause the return of the distributing valve 62 in the rest position of FIG. 3. Compressed air is then fed to the lower chamber of the cylinders 18 and 41, the first one of which causes the mutual removal, that is the "opening", of the conveying units 3, while the second one causes the release of the clutch 27 and the consequent stop of the conveying belts. The sealing head 4, held no longer by the carton thereunder, in its turn moves by itself or goes down by gravity to the initial position of minimum height.

As said at the beninning of this description, it can happen that a carton is locked inside the sealing area, when, for all said previously the valves 55 and 57 are in the rest position of FIG. 3 while the valves 56 and 62 are in unchanged position and, consequently, the sealing head 4 is laid or positioned on the top of the carton and the conveying units 3 are engaged with the carton sides, that is, as usually said, the machine is in conditions of "closure" of the sealing area.

If this happens, there is however already provided a quick remedy, represented by the pushbutton 60. By pushing it downwards, in fact, it is possible to cause the new activation of the valve 55, which on one hand causes through the cylinders 50 the lifting of the sealing head 4 in position of maximum distance from the support base 2 and on the other hand causes through the connection element 71 the opposed activation of the distributing valve 62 for the feeding of compressed air to the lower chambers of the cylinders 18 and 41 and the consequent removal of the conveying units 3 and stop of the conveying belts 12. One thus obtains the complete "opening" of the sealing area for the free, easy and sure access to the carton by the operator. By pulling up again the pushbutton 60, which in the meantime has been kept in work position by the friction exerted by the spring 64 on the sides of its stem, also the valve 55 can thus come back in rest position, making the sealing head 4 go down in rest position and therefore preparing again the machine in a condition suitable for the intervention on a new carton to be sealed. All this, as already said, can be obtained by means of the simple operation of a control member such as the pushbutton 60.

I claim:

1. A carton sealing machine, comprising:

a carton support base;

a pair of motor-driven conveying belts mounted on movable supporting structures positioned on opposite sides of said support base and movable towards each other from a position of maximum mutual separation for engagement of the belts with the carton sides and movable away from each other;

an upper sealing head engageable from above with the carton top and biased by its weight towards a rest position of maximum lowering;

first motor means for moving the supporting structures of said conveying belts towards and away from each other;

second motor means for lifting the sealing head from the rest position; and control means operatively connected to said first and second motor means when actuated for causing displacement of said belt conveying structures to the position of maximum separation and displacement of the sealing head to a position of maximum lifting with respect to said carton support base.

2. The carton sealing machine as claimed in claim 1, wherein said control means is further operatively connected to third belt-driving motor means for stopping the movement of the conveying belts when said last-mentioned motor means is actuated.

3. The carton sealing machine as claimed in claim 2, further comprising:

first sensing means carried by said sealing head engageable by the front wall of the carton before its arrival at the sealing area defined by said upper sealing head;

second sensing means carried by said sealing head for engagement with the carton top immediately after its arrival at the sealing area; and a fluiddynamic circuit for the control of said first and second motor means, said circuit comprising first and second valve means under control of said first and second sensing means, said first valve means being operatively associated with said first and second motor means for rendering them operative to cause the mutual separation of said supporting structures of the conveying belts and lifting of said sealing head, and said second valve means being operatively associated with said first motor means for moving said supporting structures of the conveying belts towards each other, said control member being mounted on said sealing head in a position such as to act, when operated, on said first valve means.

4. The carton sealing machine as claimed in claim 3, wherein said control means is a two-position bushbutton.

5. The carton sealing machine as claimed in claim 1, further comprising:

first sensing means carried by said sealing head engageable by the front wall of the carton before its arrival at the sealing area defined by said upper sealing head;

second sensing means carried by said sealing head for engagement with the carton top immediately after its arrival at the sealing area; and a fluiddynamic circuit for the control of said first and second motor means, said circuit comprising first and second valve means under control of said first and second sensing means, said first valve means being operatively associated with said first and second motor means for rendering them operative to cause the mutual separation of said supporting structures of the conveying belts and lifting of said sealing head, and said second valve means being operatively associated with said first motor means for moving said supporting structures of the conveying belts towards each other, said control member being mounted on said sealing head in a position such as to act, when operated, on said first valve means.

6. The carton sealing machine as claimed in claim 5, wherein said control means is a two-position pushbutton.

7. The carton sealing machine as claimed in claim 1, wherein said control means also stops the rotary movement of said conveying belts.

8. The carton sealing machine as claimed in claim 1, wherein said upper sealing head is stressed by its own weight towards a rest position of maximum lowering, and including a first bidirectional-operation motor means for controlling the mutual approaching and separation of said conveying belts, and second unidirectional-operation motor means for controlling the lifting of said sealing head from said position of maximum lowering; and said control means is operatively connected to said first motor means for causing maximum separation of said movable supporting structures and to said second motor means for moving said sealing head to said position of maximum lifting of the sealing head.

9. The carton sealing machine as claimed in claim 8, comprising:

first sensing means associated with said sealing head for engagement by the front wall of the carton before it enters into the sealing area;

second sensing means carried by said sealing head so as to be engaged with the carton top immediately after its inlet into the sealing area; and and a fluiddynamic circuit for the control of said motor means, said circuit comprising first and second valve means controlled by said first and second sensing means, said first valve means rendering said first and second motor means operative for the mutual separation of said conveying belts and, respectively, the lifting of said sealing head, and said second valve means rendering said first motor means operative for the mutual approaching of said conveying belts, said control means being brought by said sealing head in a position such as to act, when operated, on said first valve means.

10. The machine as claimed in claim 1, wherein said control means is a two-position pushbutton.

* * * * *